US006763809B2

(12) United States Patent
Grabandt

(10) Patent No.: US 6,763,809 B2
(45) Date of Patent: Jul. 20, 2004

(54) FUEL INJECTION APPARATUS FOR AN INTERNAL COMBUSTION ENGINE

(75) Inventor: Peter Grabandt, Remseck (DE)

(73) Assignee: Robert Bosch GmbH, Stuttgart (DE)

( * ) Notice: Subject to any disclaimer, the term of this patent is extended or adjusted under 35 U.S.C. 154(b) by 66 days.

(21) Appl. No.: 10/292,547

(22) Filed: Nov. 13, 2002

(65) Prior Publication Data

US 2003/0111053 A1 Jun. 19, 2003

(30) Foreign Application Priority Data

Nov. 14, 2001 (DE) ..... 101 55 973

(51) Int. Cl.[7] ..... F02M 33/02
(52) U.S. Cl. ..... 123/467; 123/446; 123/447
(58) Field of Search ..... 123/467, 447, 123/446; 239/88–96

(56) References Cited

U.S. PATENT DOCUMENTS 4,719,889 A * 1/1988 Amann et al. ..... 123/447
4,750,462 A * 6/1988 Egler et al. ..... 123/467
5,732,679 A * 3/1998 Takahasi et al. ..... 123/467
6,634,336 B1 * 10/2003 Kropp ..... 123/467
6,688,289 B2 * 2/2004 Rodriguez-Amaya et al. ... 123/467

* cited by examiner

*Primary Examiner*—Thomas N. Moulis
(74) *Attorney, Agent, or Firm*—Ronald E. Greigg

(57) ABSTRACT

The fuel injection apparatus has a high-pressure fuel pump and a fuel injection valve connected to it for each cylinder of the engine. The high-pressure fuel pump has a pump piston, which is driven in a stroke motion by the engine and defines a pump working chamber, which is connected by means of a line to a pressure chamber of the fuel injection valve that is disposed separate from the high-pressure fuel pump in the engine and has an injection valve member, which is used to control at least one injection opening and can be moved by the pressure prevailing in the pressure chamber in an opening direction, counter to a closing force, in order to unblock the at least one injection opening. An electrically actuated control valve is provided in the fuel injection valve and at least indirectly controls a connection of the pump working chamber to a relief chamber, which can store pressurized fuel diverted by the control valve when this valve is open.

20 Claims, 2 Drawing Sheets

FUEL INJECTION APPARATUS FOR AN INTERNAL COMBUSTION ENGINE

BACKGROUND OF THE INVENTION

1. Field of the Invention

The invention is directed to an improved fuel injection apparatus for an internal combustion engine.

2. Description of the Prior Art

A fuel injection apparatus of the type with which this invention is concerned is known from EP 0 957 261 A1 which discloses a high-pressure fuel pump and a fuel injection valve connected to it for each cylinder of the internal combustion engine. The high-pressure fuel pump has a pump piston which the engine sets into a stroke motion and which defines a pump working chamber. The fuel injection valve has a pressure chamber connected to the pump working chamber and has an injection valve member, which controls at least one injection opening and which the pressure prevailing in the pressure chamber can move in an opening direction in order to unblock the at least one injection opening. The high-pressure fuel pump and the fuel injection valve are disposed separate from each other in the engine. The high-pressure fuel pump is provided with an electrically actuated control valve, which controls a connection of the pump working chamber and therefore of the line to a relief chamber, which function is at least indirectly fulfilled by the fuel tank. In this known fuel injection apparatus, it is disadvantageous that when the control valve is open, fuel delivered by the high-pressure fuel pump is diverted toward the fuel tank and in the subsequent intake stroke of the pump piston, this piston must aspirate the entire fuel quantity once again. This decreases the efficiency of the fuel injection apparatus. Furthermore, diverting fuel delivered by the pump piston toward the fuel tank produces pressure surges in the low-pressure system connected to it, which impairs the function and service life of the fuel injection apparatus.

OBJECT AND SUMMARY OF THE INVENTION

The fuel injection apparatus according to the invention has the advantage over the prior art that the control valve diverts fuel into the reservoir from which fuel is drawn in a subsequent intake stroke of the pump piston so that the pump working chamber only needs to aspirate part of the fuel quantity, which is required for the filling, from the fuel tank. Furthermore, no pressure surges are produced in the low-pressure region of the fuel injection apparatus when the control valve diverts the fuel into the reservoir.

Advantageous embodiments and modifications of the fuel injection apparatus according to the invention are disclosed. In one embodiment, the reservoir has a large enough volume to contain the fuel quantity that is diverted by the control valve, even when there is a smaller fuel injection quantity and therefore a greater diverted fuel quantity. Another modification permits a flexible control of the fuel injection in that the fuel injection valve can be closed when there is high pressure in the control pressure chamber.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
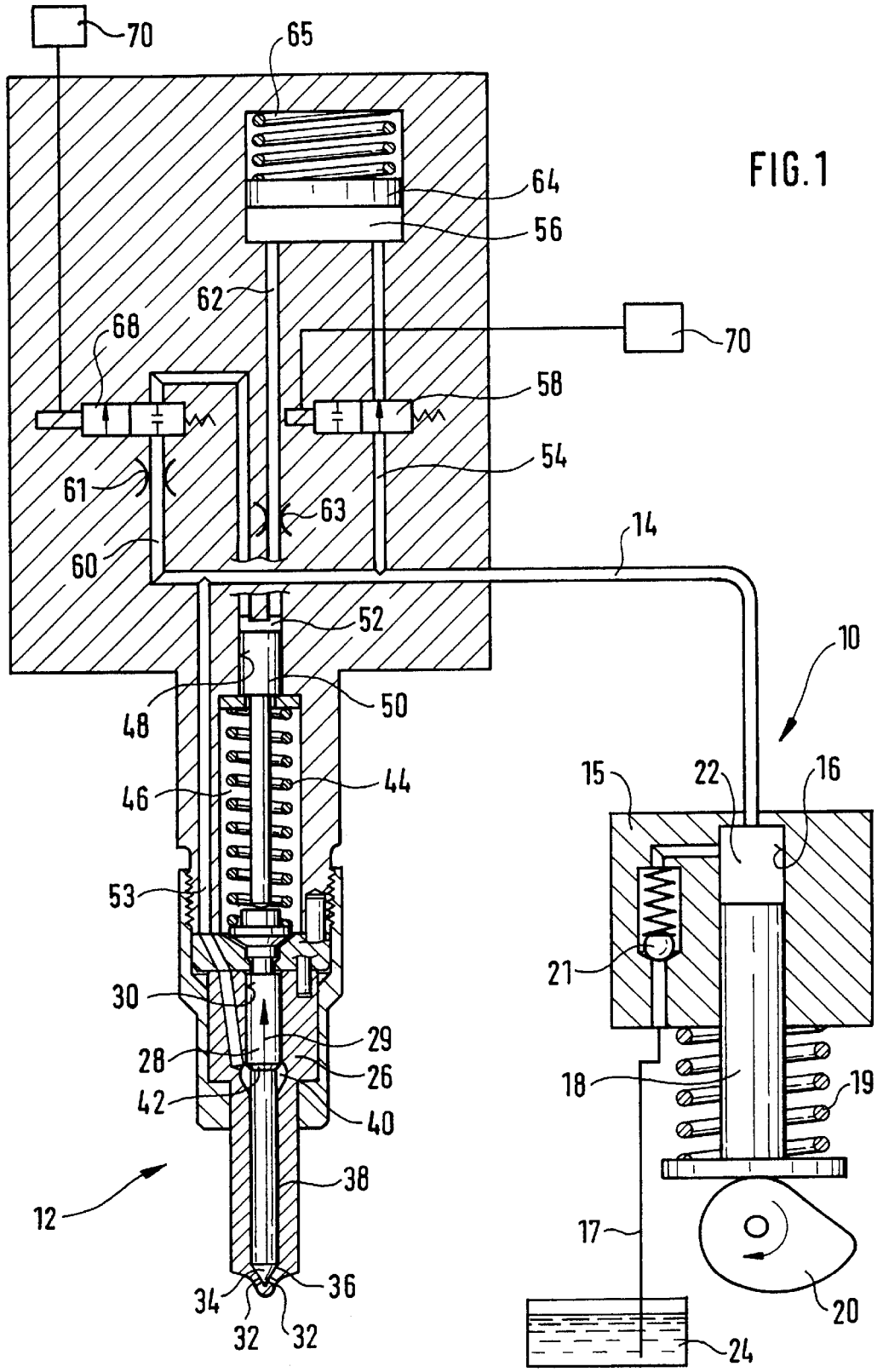
FIG. 1 shows a schematic depiction of a fuel injection apparatus for an internal combustion engine, according to a first exemplary embodiment.
Figure 3:
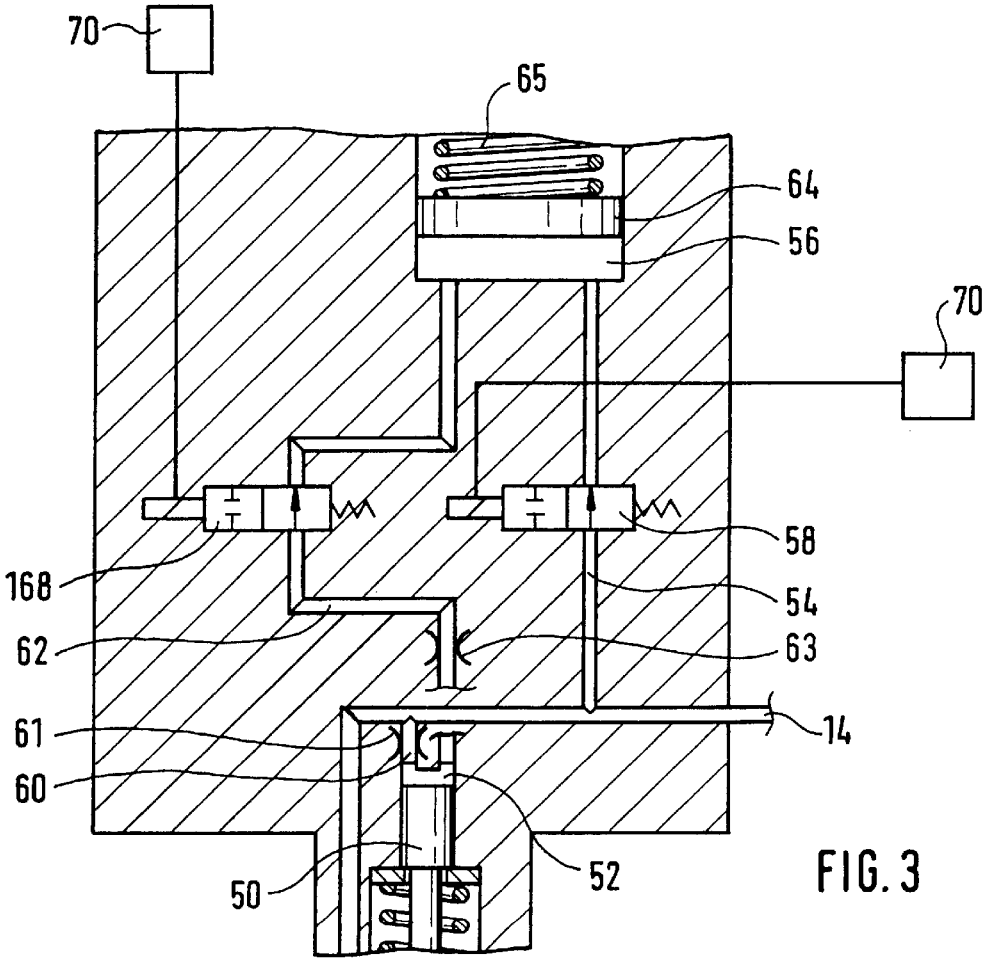
FIG. 3 shows the fuel injection apparatus according to a second exemplary embodiment.

FIGS. 1 and 3 show a fuel injection apparatus for an internal combustion engine of a motor vehicle. The fuel injection apparatus is embodied as a so-called unit pump system and for each cylinder of the engine, has a fuel pump 10, a fuel injection valve 12, and a line 14 that connects the fuel injection valve 12 to the fuel pump 10. The fuel pump 10 has a pump piston 18, which is guided in a sealed fashion in a cylinder bore 16 of a pump body 15 and is driven into a stroke motion counter to the force of a return spring 19 by a cam 20 of a camshaft of the engine. In the cylinder bore 16, the pump piston 18 defines a pump working chamber 22 in which the pump piston 18 compresses fuel at high pressure. The pump working chamber 22 is supplied with fuel from the fuel tank 24, for example by means of a low-pressure pump, not shown. The pump working chamber 22 has a connection 17 that leads to the fuel tank 24 and is provided with a check valve 21, which opens toward the pump working chamber 22 and can be disposed in the pump body 15.

The fuel injection valve 12 is disposed separate from the fuel pump 10 and is connected to the pump working chamber 22 by means of the line 14. The fuel injection valve 12 has a valve body 26, which can be comprised of several parts, in which a piston-shaped injection valve member 28 is guided so that it can move longitudinally in a bore 30. In its end region oriented toward the combustion chamber of the cylinder of the engine, the valve body 26 has at least one, preferably several, injection openings 32. In its end region oriented toward the combustion chamber, the injection valve member 28 has a for example approximately conical sealing surface 34 that cooperates with a valve seat 36, which is embodied in the valve body 26, and the injection openings 32 lead away from this valve seat 36 or branch off downstream of it. In the valve body 26, between the injection valve member 28 and the bore 30 toward the valve seat 36, there is an annular chamber 38, which transitions by means of a radial expansion of the bore 30 into a pressure chamber 40 that encompasses the injection valve member 28. In the vicinity of the pressure chamber 40, the injection valve member 28 has a pressure shoulder 42. A prestressed closing spring 44 acts on the end of the injection valve member 28 oriented away from the combustion chamber and presses the injection valve member 28 toward the valve seat 36. The closing spring 44 is disposed in a spring chamber 46 of the valve body 26, which chamber adjoins the bore 30. At its end oriented away from the bore 30 in the valve body 26, the spring chamber 46 can be adjoined by another bore 48 that has a control piston 50 guided in it in a sealed fashion, which is connected to the injection valve member 28. With its end face oriented away from the spring chamber 46, the piston 50 defines a control pressure chamber 52 in the valve body 26.

The line 14 feeds into the valve body 26 and in it, leads into a conduit, which is embodied in the valve body 26 and leads to the pressure chamber 40. Inside the valve body 26, a conduit 54 branches off from the line 14 and leads to a reservoir 56 embodied in the valve body 26. An electrically actuated control valve 58 controls the passage through the conduit 54. Inside the valve body 26, a conduit 60 that leads to the control pressure chamber 52 can also branch from the line 14. The control pressure chamber 52 is also connected to the reservoir 56 by means of a conduit 62.

The reservoir 56 can, for example, be embodied in a bore in the valve body 26, which bore has a flexible boundary in the form of a reservoir piston 64, which is supported by a prestressed return spring 65. The reservoir 56 is dimensioned so that the volume that can be contained in the reservoir 56 is at least as great as the volume that the pump piston 18 of the high-pressure fuel pump 10 delivers during a delivery stroke.

In a first exemplary embodiment of the fuel injection apparatus shown in FIG. 1, an additional electrically actuated control valve 68 is provided, which controls the passage through the conduit 60 from the line 14 into the control pressure chamber 52. Preferably a first throttle restriction 61 is provided in the conduit 60 and preferably a second throttle restriction 63 is provided in the conduit 62 from the control pressure chamber 52 to the reservoir 56. The control pressure chamber 52 is continuously connected to the reservoir 56 by means of the conduit 62. The inflow and outflow of fuel into and out of the control pressure chamber 52 can be adjusted or set in a suitable manner through appropriate dimensioning of the throttle restrictions 61, 63. The two control valves 58 and 68 can each have an electromagnetic actuator, a piezoelectric actuator, or some other fast-switching actuator. An electronic control device 70 controls the control valves 58, 68 as a function of operating parameters of the engine. As shown in FIG. 1, the two control valves 58, 68 can each be embodied as a 2/2-port directional-control valve, which can be switched between an open switched position, in which the passage through the conduit 60 or 62 is open, and a closed switched position, in which the passage through the conduit 60 or 62 is closed.

The function of the fuel injection apparatus according to the first exemplary embodiment will now be explained. During the intake stroke of the pump piston 18, the first control valve 58 is disposed in its open switched position so that the connection of the line 14 to the reservoir 56 is open. The second control valve 68 is disposed in its closed switched position so that the control pressure chamber 52 is disconnected from the line 14. Fuel stored under pressure in the reservoir 56 is supplied via the line 14 to the pump working chamber 22 until the reservoir 56 is emptied. The pressure in the reservoir 56 is therefore preferably higher than the pressure in the low-pressure region of the fuel injection apparatus upstream of the check valve 21 so that this check valve is closed until the reservoir 56 is empty. With another intake stroke, the pump piston 18 aspirates fuel from the fuel tank 24 when the check valve 21 is open. During the subsequent delivery stroke of the pump piston 18, the check valve 21 closes and the pump piston 18 delivers fuel to the fuel injection valve 12 via the line 14. During the delivery stroke of the pump piston 18, the first control valve 58 can be disposed in its open switched position so that at first, fuel is delivered into the reservoir 56 and not enough high pressure can build up to produce a fuel injection. At the beginning of the fuel injection, the control device 70 then switches the first control valve 58 into its closed switched position so that the line 14 is disconnected from the reservoir 56. It is also possible for the first control valve 58 to be brought into its closed switched position during the delivery of the pump piston 18 and for the second control valve 68 to be brought into its open switched position. The control pressure chamber 52 is then connected to the line 14 so that an increased pressure prevails in this control pressure chamber 52, which keeps the fuel injection valve 12 closed by means of the control piston 50. When the fuel injection is to begin, then the control device 70 moves the second control valve 68 into its closed switched position so that the control pressure chamber 52 is disconnected from the line 14 and only the pressure of the reservoir 56 prevails in this control pressure chamber 52. When the pressure prevailing in the pressure chamber 40 of the fuel injection valve 12 generates a force on the injection valve member 28 that exceeds the force of the closing spring 44 and the compressive force acting on the control piston 50, then this injection valve member 28 moves in the opening direction 29 and unblocks the injection openings 32.

Figure 2:
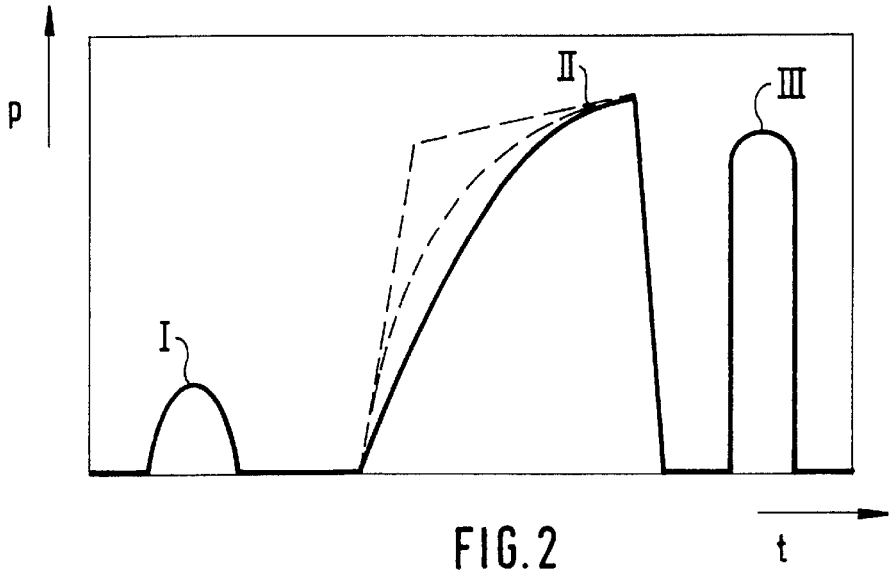
FIG. 2 shows a march of pressure at injection openings of a fuel injection valve of the fuel injection apparatus according to the first exemplary embodiment.

FIG. 2 shows the march of pressure at the injection openings 32 of the fuel injection valve 12 over time during an injection cycle. Due to the profile of the cam 20, the fuel injection explained above occurs at a relatively low pressure and a small injection quantity during a preinjection phase labeled I in FIG. 2.

In order to terminate the preinjection, the control device 70 moves the first control valve 58 into its open switched position so that the fuel delivered by the pump piston 18 travels into the reservoir 56 and the pressure in the pressure chamber 40 drops in such a way that the fuel injection valve 12 closes. Alternatively, the first control valve 58 can also remain in its closed switched position, wherein the control device 70 moves the second control valve 68 into its open switched position so that high pressure prevails in the control pressure chamber 52 and closes the fuel injection valve 12 by means of the control piston 50.

Then, for a main injection of fuel, the control device 70 moves the first control valve 58 into its closed switched position so that the reservoir 56 is disconnected from the line and moves the second control valve 68 into its closed switched position so that the control pressure chamber 52 is disconnected from the line 14. High pressure then builds up in the pressure chamber 40 of the fuel injection valve 12 in accordance with the profile of the cam 20 and the fuel injection valve 12 opens since the control pressure chamber 52 is pressure-relieved. Then an injection of fuel occurs in a main injection phase labeled II in FIG. 2. The time at which the control device 70 switches the second control valve 68 into its closed switched position can influence the time and therefore the pressure at which the main injection begins. The later the second control valve 68 is closed, the higher the pressure at which the main injection begins. This is shown in FIG. 2 by a march of pressure depicted with a dashed line.

In order to terminate the main injection, the control device 70 moves the second control valve 68 into its open switched position so that the control piston 50 closes the fuel injection valve 12 due to the high pressure prevailing in the control pressure chamber 52. High pressure also prevails in the pressure chamber 40 due to the fact that the first control valve 58 remains in its closed switched position. For a secondary injection of fuel in a phase labeled III in FIG. 2, the control device 70 closes the second control valve 68 again so that the control pressure chamber 52 is pressure-relieved and the fuel injection valve 12 opens. In order to terminate the fuel injection, the control device 70 moves the first control valve 58 into its open switched position and moves the second control valve 68 into its open switched position or leaves it in its closed switched position.

When the first control valve 58 is open, fuel delivered by the pump piston 18 during its delivery stroke is diverted from the line 14 into the reservoir 56. As an increasing fuel volume flows into the reservoir, the reservoir piston 64 moves counter to the force of the return spring 65 and the pressure in the reservoir 56 increases. If only a small quantity of fuel is injected during the fuel injection, which is the case for example when the engine is idling or is operating at a low load, then a large quantity of fuel is diverted into the reservoir 56 and a high pressure is produced in the reservoir 56. During the subsequent intake stroke of the pump piston 18, this piston consequently only has to aspirate a small quantity of fuel from the fuel tank 24. If a large quantity of fuel is injected during the fuel injection, which is the case for example when the engine is operating at a high load, then only a small quantity of fuel is diverted into the reservoir 56 and a relatively low pressure is produced in the reservoir 56. During the subsequent intake stroke of the pump piston 18, this piston consequently has to aspirate a large quantity of fuel from the fuel tank 24.

FIG. 3 shows the fuel injection apparatus according to a second exemplary embodiment in which the basic design is the same as in the first exemplary embodiment, and only the disposition of the second control valve 168 has been modified. The second control valve 168 is disposed in such a way that it controls the passage through the conduit 62 from the control pressure chamber 52 into the reservoir 56. The control pressure chamber 52 is continuously connected to the line 14 by means of the conduit 60 with the throttle restriction 61. The control device 70 controls the second control valve 168 during the fuel injection in a manner opposite from that of the control valve 68 in the first exemplary embodiment. In the starting position, the second control valve 168 is open so that the control pressure chamber 52 is connected to the reservoir 56. If a fuel injection is to occur, then the control device 70 moves the second control valve 168 into its open switched position. In order to interrupt the fuel injection between the preinjection and the main injection or between the main injection and the secondary injection, the control device 70 moves the second control valve 168 into its closed switched position so that the control pressure chamber 52 is disconnected from the reservoir 56 and high pressure prevails in it.

In a simplified embodiment of the fuel injection apparatus, the second control valve 68 and/or 168 as well as the control piston 50 and the control pressure chamber 52 can be eliminated and solely the first control valve 58 is provided. In this case, the fuel injection is controlled only by means of the first control valve 58, wherein during the delivery stroke of the pump piston 18, when the control valve 58 is open, high pressure cannot build up in the pump working chamber 22, the line 14, and the pressure chamber 40 and consequently, no fuel injection takes place. When the control valve 58 is closed, high pressure can build up in the pressure chamber 40 and the fuel injection valve 12 opens when the force that the pressure in the pressure chamber 40 exerts on the injection valve member 28 in the opening direction 29 is greater than the force of the closing spring 44. In order to interrupt or terminate the fuel injection, the control valve 58 is opened so that the pressure chamber 40 is pressure-relieved.

The foregoing relates to preferred exemplary embodiments of the invention, it being understood that other variants and embodiments thereof are possible within the spirit and scope of the invention, the latter being defined by the appended claims.

I claim:

1. A fuel injection apparatus for an internal combustion engine, the apparatus comprising a high-pressure fuel pump (10) and a fuel injection valve (12) connected to the pump (10) for each cylinder of the engine, the high-pressure fuel pump (10) having a pump piston (18) driven in a stroke motion by the engine and defining a pump working chamber (22), the fuel injection valve (12) having a pressure chamber (40) connected to the pump working chamber (22) by means of a line (14), the pressure chamber (40) being disposed separate from the high-pressure fuel pump (10) in the engine and having an injection valve member (28), which is used to control at least one injection opening (32) and which can be moved by the pressure prevailing in the pressure chamber (40) in an opening direction (29), counter to a closing force, in order to unblock the at least one injection opening (32), and, an electrically actuated control valve (58) which at least indirectly controls a connection (54) of the pump working chamber (22) to a relief chamber (56), the control valve (58) being disposed in the fuel injection valve (12) and the fuel injection valve (12) being provided with a reservoir (56) that functions as a relief chamber, which can store pressurized fuel diverted by the control valve (58) when this valve is open.

2. The fuel injection apparatus according to claim 1, wherein the volume of the reservoir (56) is at least as great as the volume that the pump piston (18) delivers during a delivery stroke.

3. The fuel injection apparatus according to claim 1, wherein the reservoir (56) has a flexible boundary (64).

4. The fuel injection apparatus according to claim 2, wherein the reservoir (56) has a flexible boundary (64).

5. The fuel injection apparatus according to claim 1, further comprising a control pressure chamber (52), an additional electrically actuated control valve (68; 168) disposed in the fuel injection valve (12) and which controls the pressure prevailing in the control pressure chamber (52), the control pressure chamber (52) being defined by a control piston (50) that acts on the injection valve member (28) in a closing direction by means of the pressure prevailing in the control pressure chamber (52).

6. The fuel injection apparatus according to claim 2, further comprising a control pressure chamber (52), an additional electrically actuated control valve (68; 168) disposed in the fuel injection valve (12) and which controls the pressure prevailing in the control pressure chamber (52)

the control pressure chamber (52), being defined by a control piston (50) that acts on the injection valve member (28) in a closing direction by means of the pressure prevailing in the control pressure chamber (52).

7. The fuel injection apparatus according to claim 3, further comprising a control pressure chamber (52), an additional electrically actuated control valve (68; 168) disposed in the fuel injection valve (12) and which controls the pressure prevailing in the control pressure chamber (52), the control pressure chamber (52) being defined by a control piston (50) that acts on the injection valve member (28) in a closing direction by means of the pressure prevailing in the control pressure chamber (52).

8. The fuel injection apparatus according to claim 4, further comprising a control pressure chamber (52), an additional electrically actuated control valve (68; 168) disposed in the fuel injection valve (12) and which controls the pressure prevailing in the control pressure chamber (52), the control pressure chamber (52) being defined by a control piston (50) that acts on the injection valve member (28) in a closing direction by means of the pressure prevailing in the control pressure chamber (52).

9. The fuel injection apparatus according to claim 5, wherein the additional control valve (68) controls a connection (60) of the control pressure chamber (52) at least indirectly to the pump working chamber (22), wherein the control pressure chamber (52) has a continuously open connection (62) to the reservoir (56), and wherein a throttle restriction (61; 63) is preferably disposed in each of the connections (60; 62) of the control pressure chamber (52).

10. The fuel injection apparatus according to claim 6, wherein the additional control valve (68) controls a connection (60) of the control pressure chamber (52) at least indirectly to the pump working chamber (22), wherein the control pressure chamber (52) has a continuously open connection (62) to the reservoir (56), and wherein a throttle restriction (61; 63) is preferably disposed in each of the connections (60; 62) of the control pressure chamber (52).

11. The fuel injection apparatus according to claim 7, wherein the additional control valve (68) controls a connection (60) of the control pressure chamber (52) at least indirectly to the pump working chamber (22), wherein the control pressure chamber (52) has a continuously open connection (62) to the reservoir (56), and wherein a throttle restriction (61; 63) is preferably disposed in each of the connections (60; 62) of the control pressure chamber (52).

12. The fuel injection apparatus according to claim 8, wherein the additional control valve (68) controls a connection (60) of the control pressure chamber (52) at least indirectly to the pump working chamber (22), wherein the control pressure chamber (52) has a continuously open connection (62) to the reservoir (56), and wherein a throttle restriction (61; 63) is preferably disposed in each of the connections (60; 62) of the control pressure chamber (52).

13. The fuel injection apparatus according to claim 5, wherein the additional control valve (168) controls a connection (62) of the control pressure chamber (52) to the reservoir (56), wherein the control pressure chamber (52) has a continuously open connection (60) at least indirectly to the pump working chamber (22), and wherein a throttle restriction (61; 63) is preferably provided in each of the connections (60; 62) of the control pressure chamber (52).

14. The fuel injection apparatus according to claim 6, wherein the additional control valve (168) controls a connection (62) of the control pressure chamber (52) to the reservoir (56), wherein the control pressure chamber (52) has a continuously open connection (60) at least indirectly to the pump working chamber (22), and wherein a throttle restriction (61; 63) is preferably provided in each of the connections (60; 62) of the control pressure chamber (52).

15. The fuel injection apparatus according to claim 7, wherein the additional control valve (168) controls a connection (62) of the control pressure chamber (52) to the reservoir (56), wherein the control pressure chamber (52) has a continuously open connection (60) at least indirectly to the pump working chamber (22), and wherein a throttle restriction (61; 63) is preferably provided in each of the connections (60; 62) of the control pressure chamber (52).

16. The fuel injection apparatus according to claim 8, wherein the additional control valve (168) controls a connection (62) of the control pressure chamber (52) to the reservoir (56), wherein the control pressure chamber (52) has a continuously open connection (60) at least indirectly to the pump working chamber (22), and wherein a throttle restriction (61; 63) is preferably provided in each of the connections (60; 62) of the control pressure chamber (52).

17. The fuel injection apparatus according to claim 1, wherein the pump working chamber (22) in the high-pressure fuel pump (10) has a connection to a fuel tank (24) by means of a low-pressure region and this connection contains a check valve (21) that opens toward the pump working chamber (22).

18. The fuel injection apparatus according to claim 2, wherein the pump working chamber (22) in the high-pressure fuel pump (10) has a connection to a fuel tank (24) by means of a low-pressure region and this connection contains a check valve (21) that opens toward the pump working chamber (22).

19. The fuel injection apparatus according to claim 3, wherein the pump working chamber (22) in the high-pressure fuel pump (10) has a connection to a fuel tank (24) by means of a low-pressure region and this connection contains a check valve (21) that opens toward the pump working chamber (22).

20. The fuel injection apparatus according to claim 5, wherein the pump working chamber (22) in the high-pressure fuel pump (10) has a connection to a fuel tank (24) by means of a low-pressure region and this connection contains a check valve (21) that opens toward the pump working chamber (22).

* * * * *